US008814305B2

(12) United States Patent
Mizes et al.

(10) Patent No.: US 8,814,305 B2
(45) Date of Patent: Aug. 26, 2014

(54) SYSTEM AND METHOD FOR FULL-BLEED AND NEAR FULL-BLEED PRINTING

(71) Applicant: Xerox Corporation, Norwalk, CT (US)

(72) Inventors: Howard A. Mizes, Pittsford, NY (US); Joseph C. Sheflin, Macedon, NY (US); Michael J. Levy, Webster, NY (US); Charles D. Rizzolo, Fairport, NY (US); Stuart A. Schweid, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 26 days.

(21) Appl. No.: 13/685,315

(22) Filed: Nov. 26, 2012

(65) Prior Publication Data

US 2014/0146102 A1 May 29, 2014

(51) Int. Cl.
*B41J 29/393* (2006.01)
*B41J 2/07* (2006.01)

(52) U.S. Cl.
CPC ..... *B41J 2/07* (2013.01)
USPC ..... 347/14

(58) Field of Classification Search
CPC .. B41J 11/0065; B41J 11/0095; B41J 11/008; B41J 29/393
USPC ..... 347/14
See application file for complete search history.

(56) References Cited

U.S. PATENT DOCUMENTS

| | | | | |
|---|---|---|---|---|
| 5,600,350 | A * | 2/1997 | Cobbs et al. | 347/19 |
| 6,137,515 | A | 10/2000 | Dickinson | |
| 6,352,332 | B1 * | 3/2002 | Walker | 347/19 |
| 6,409,305 | B1 | 6/2002 | Elgee et al. | |
| 6,447,089 | B1 | 9/2002 | Arquilevich et al. | |
| 7,456,995 | B2 | 11/2008 | Stephens | |
| 7,506,947 | B2 * | 3/2009 | Uchida | 347/14 |
| 7,507,046 | B2 | 3/2009 | Ehmann | |
| 2007/0002095 | A1 | 1/2007 | Ozawa et al. | |
| 2007/0091132 | A1 * | 4/2007 | Lim | 347/14 |
| 2011/0242186 | A1 | 10/2011 | Mizes et al. | |
| 2011/0242187 | A1 | 10/2011 | Mongeon et al. | |

* cited by examiner

*Primary Examiner* — Stephen Meier
*Assistant Examiner* — Alexander D Shenderov
(74) *Attorney, Agent, or Firm* — Maginot, Moore & Beck, LLP

(57) ABSTRACT

A method of operating a printer includes identifying a region of a print medium located between marks formed by a first plurality of inkjets in the printer and an edge of the print medium. The printer activates a second plurality of inkjets to print ink drops into the region during a printing operation. The method enables full-bleed or near full-bleed printing for different media sizes.

14 Claims, 5 Drawing Sheets

SYSTEM AND METHOD FOR FULL-BLEED AND NEAR FULL-BLEED PRINTING

TECHNICAL FIELD

This disclosure relates generally to inkjet printers, and, more particularly, to printer that print images that extend to at least one edge of a print medium.

BACKGROUND

Some printing processes produce a "full-bleed" printed page in which a printed image extends to at least one edge of the printed page. Common examples of a full-bleed printed page include full-page printed photographs. One traditional method for producing a full-bleed printed page is to print an image that is larger than the intended final size of the image onto a print medium that is also larger than the final size of the printed page. After forming the printed image on the print medium, a cutting device removes marginal portions of the print medium and part of the image to leave a full-bleed printed page. In an existing full-bleed printing technique, the print medium is commonly paper and the cutting process produces waste paper. The wasted paper increases the expense of full-bleed printing because the printing process requires the use of a print medium that is larger, and more expensive, than the minimum size of a print medium that would produce the full-bleed printed pages. For example, to produce a full-bleed printed page with a width of 19.5 inches, the printer uses paper rolls or sheets with a width of 20 inches. A finishing device cuts the paper to the smaller 19.5-inch size after the printing process. For high-volume printing, the additional expense for using the larger print medium size can substantially increase the printing costs, and produce a large amount of wasted paper.

High capacity inkjet printers can be used for printing full-bleed images. For example, a continuous feed or "web" inkjet printer prints ink images on an elongated print medium, such as a paper roll. The continuous feed inkjet printers can be used for high volume printing runs to produce a large number of full-bleed printed documents. The continuous feed printers typically include an array of fixed printheads that extend across a print zone and are wider in a cross-process direction than the width of the print medium in the cross-process direction. Existing inkjet printers are configured to deactivate some of the inkjets in the print zone to leave a margin on each side of the print medium in the cross-process direction. The margin ensures that ink drops ejected from the printheads in the printer are transferred to the print medium instead of backer rollers or other components in the printer. Ink may accumulate on components in the printer in amounts sufficient to degrade the quality of printed images and/or reduce the reliability of the printer. Thus, existing inkjet printers are configured to form ink images with a perceptible margin to ensure high quality printed output and reliable printing operations. Improvements to inkjet printers that enable the printers to produce full-bleed printed images or near full-bleed printed images with reduced margin sizes while also reducing the effects of ink contamination in the printer would be beneficial.

SUMMARY

In one embodiment, a method of operating a printer to form full-bleed and near full-bleed printed images on a print medium has been developed. The method includes ejecting ink drops from a first plurality of inkjets to form a plurality of marks on a surface of a print medium in a region having a first predetermined size, generating, with an optical sensor, image data corresponding to the surface of the print medium and the plurality of marks on the surface of the print medium, identifying with reference to the image data a region on the surface of the print medium that is between the plurality of marks on the surface of the print medium in the region having the first predetermined size and a location of an edge of the print medium in a cross-process direction, identifying a second plurality of inkjets that are positioned to eject ink drops outside of the region have the first predetermined size and onto the print medium, and activating the second plurality of inkjets to enable the first plurality of inkjets and the second plurality of inkjets to eject ink drops during a printing operation.

In another embodiment, a printer that is configured to form full-bleed and near full-bleed printed images on a print medium has been developed. The printer includes a media transport configured to move a print medium through the printer in a process direction, a plurality of inkjets configured to eject ink drops onto the print medium, the plurality of inkjets being arranged in a cross-process direction, an optical sensor configured to generate image data corresponding to a surface of the print medium and ink marks formed on the print medium, and a controller operatively connected to the media transport, the plurality of inkjets, and the optical sensor. The controller is configured to generate firing signals for a first portion of the plurality of inkjets to eject ink drops to form a plurality of marks on the surface of the print medium in a region having a predetermined size, generate image data corresponding to the surface of the print medium and the plurality of marks on the surface of the print medium in the region having the predetermined size, identify with reference to the image data a region on the print medium between the plurality of marks on the surface of the print medium in the region having a predetermined size and a location of an edge of the print medium in a cross-process direction, identify a second portion of the plurality of inkjets that are positioned to eject ink drops outside of the region having the predetermined size and on the print medium, and generate firing signals for the second portion of the plurality of inkjets to eject ink drops outside of the region having the predetermined size and onto the print medium during a printing operation.

BRIEF DESCRIPTION OF THE DRAWINGS

The foregoing aspects and other features of a printer that prints full-bleed and near full-bleed ink images are explained in the following description, taken in connection with the accompanying drawings.

DETAILED DESCRIPTION

Figure 1:
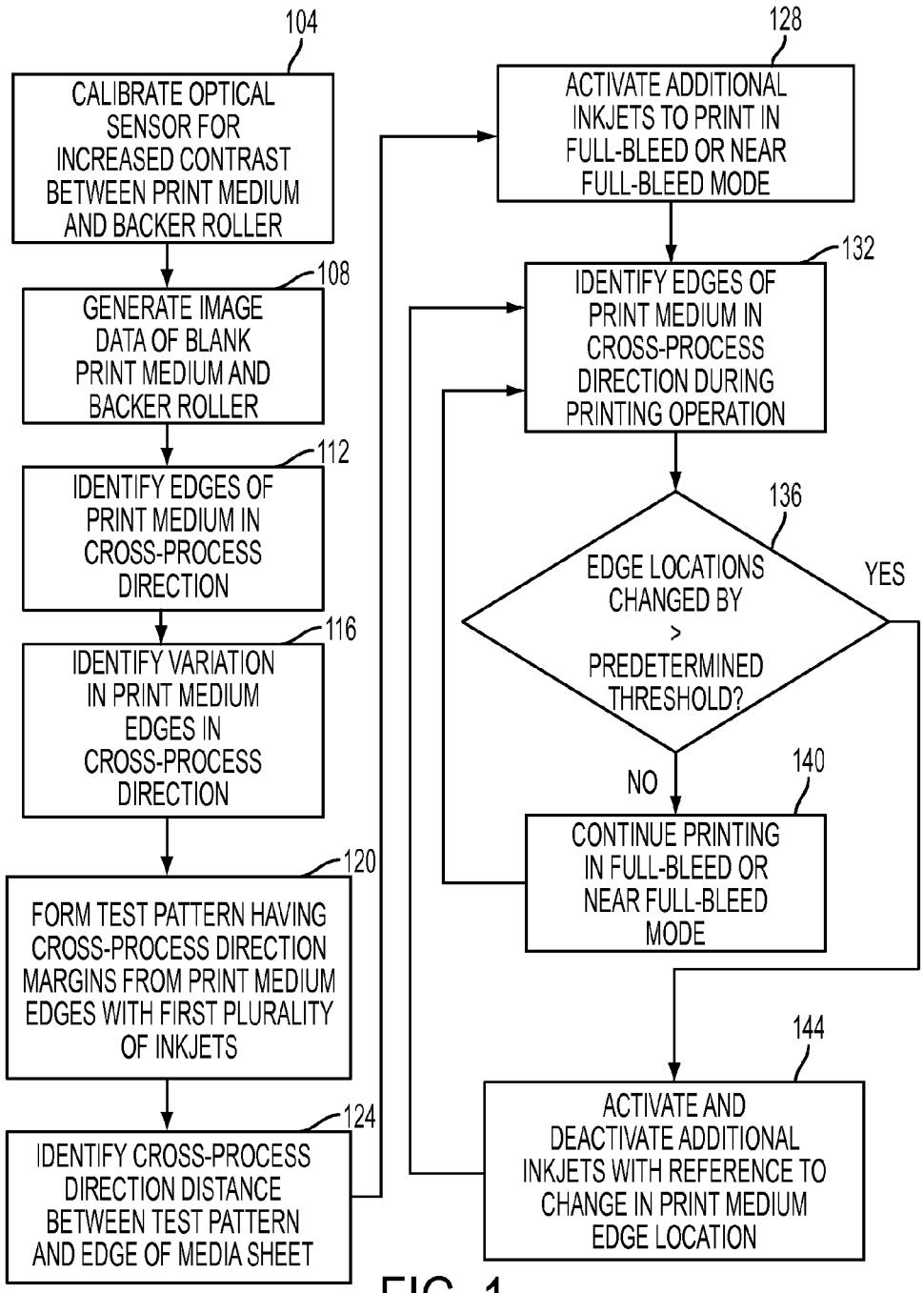
FIG. 1 is a block diagram of a process 100 for printing ink images in a full-bleed or near full-bleed mode in an inkjet printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, etc.

As used herein, the term "pixel" refers to a single location in a two-dimensional arrangement of image data corresponding to a printed image that a printer forms on an image receiving surface. The locations of pixels in the image data correspond to locations of a marking agent, such as ink or toner, on the image receiving surface that form the printed image when the printer forms the printed image with reference to the image data. The pixel locations on the image receiving surface have dimensions corresponding to the resolution of the printed image.

As used herein, the term "process direction" refers to a direction of movement of a print medium, such as a paper sheet or continuous media web, along a media path through a printer. The print medium moves past one or more printheads in the print zone to receive ink images and passes other printer components, such as heaters, fusers, pressure rollers, and on-sheet imaging sensors, that are arranged along the media path. As used herein, the term "cross-process" direction refers to an axis that is perpendicular to the process direction along the surface of the print medium.

As used herein, the term "full-bleed" refers to a print mode in an inkjet printer that ejects ink drops over a full width of the print medium in a cross-process direction so that ink drops are located at or near edges of the print medium. As used herein, the term "near full-bleed" describes a print mode in the inkjet printer that forms ink images on the print medium with an imperceptible or nearly imperceptible margin. For example, one near full-bleed print mode forms printed images with a margin that is less than one hundred microns in width. The margin is imperceptible to an average person when viewed without magnification and at a normal viewing distance. In other instances, the margin is perceptible but remains sufficiently narrow that the margin does not need to be removed from the print medium after printing, and the print mode does not require the use of a print medium size that is larger than the size of the finished printed paper. For example, a near full-bleed print mode of a 19.5 inch wide image on a 19.5 inch wide print medium with a margin of 0.2 mm can form the printed image with an acceptable quality that does not require purchase of a larger print medium such as a 20 inch wide print medium. The printer crops a small portion of the edges of the image data or rescales the image data to form the printed image with narrow margins. In this document, references to full-bleed and near full-bleed printing operations are used interchangeably unless the two operations are specifically distinguished from one another.

Figure 5:
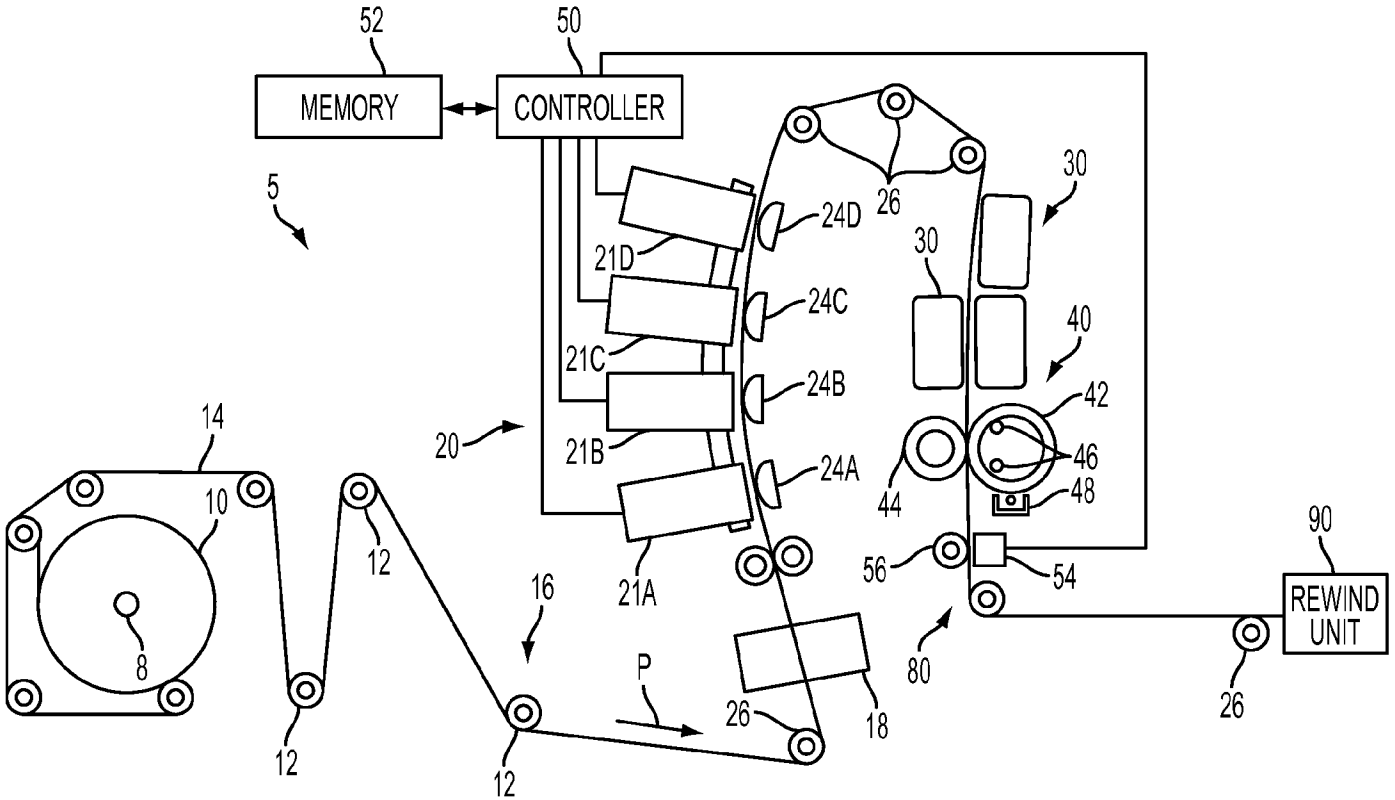
FIG. 5 PRIOR ART
FIG. 5 is a schematic diagram of a prior art printer that can be configured to print in a full-bleed or near full-bleed print mode.

FIG. 5 depicts a prior-art inkjet printer 5. For the purposes of this disclosure, an inkjet printer employs one or more inkjet printheads to eject drops of ink into an image receiving member such as paper, another print medium, or an indirect member such as a rotating image drum or belt. The printer 5 is configured to print ink images with a "phase-change ink," by which is meant an ink that is substantially solid at room temperature and that transitions to a liquid state when heated to a phase change ink melting temperature for jetting onto the imaging receiving member surface. The phase change ink melting temperature is any temperature that is capable of melting solid phase change ink into liquid or molten form. In one embodiment, the phase change ink melting temperature is approximately 70° C. to 140° C. In alternative embodiments, the ink utilized in the printer comprises UV curable gel ink. Gel inks are also heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink, or any suitable substance that includes one or more dyes or pigments and that is applied to the selected media. The colorant can be black, or any other desired color, and some printer configurations apply a plurality of distinct colorants to the media. The media includes any of a variety of substrates, including plain paper, coated paper, glossy paper, or transparencies, among others, and the media can be available in sheets, rolls, or other physical formats.

The printer 5 is an example of a direct-to-web, continuous-media, phase-change inkjet printer that includes a media supply and handling system configured to supply a long (i.e., substantially continuous) web of media 14 of "substrate" (paper, plastic, or other printable material) from a media source, such as spool of media 10 mounted on a web roller 8. The media web 14 includes a large number (e.g. thousands or tens of thousands) of individual pages that are separated into individual sheets with commercially available finishing devices after completion of the printing process. Some webs include perforations that are formed between pages in the web to promote efficient separation of the printed pages. For simplex printing, the printer 5 passes the media web 14 through a media conditioner 16, print zone 20, printed web conditioner 80, and rewind unit 90 once.

The media web 14 is unwound from the source 10 as needed and a variety of motors, not shown, rotate one or more rollers 12 and 26 to propel the media web 14. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media is transported through a print zone 20 that includes a series of marking units or units 21A, 21B, 21C, and 21D, each marking unit effectively extends across the width of the media and is able to eject ink directly (i.e., without use of an intermediate or offset member) onto the moving media. In printer 5, each of the printheads ejects a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer. In various configurations, a marking unit for each primary color includes one or more printheads; multiple printheads in a single marking unit are formed into a single row or multiple row array; printheads of a multiple row array are staggered; a printhead prints more than one color; or the printheads or portions thereof are mounted movably in a direction transverse to the process direction P for printing operations, such as for spot-color applications and the like.

Associated with each marking unit is a backing member 24A-24D, typically in the form of a bar or roll, which is arranged substantially opposite the printhead on the back side of the media. Each backing member positions the media at a predetermined distance from the printhead opposite the backing member. The backing members 24A-24D are optionally configured to emit thermal energy to heat the media to a predetermined temperature, which is in a range of about 40° C. to about 60° C. in printer 5. The various backer members can be controlled individually or collectively. The pre-heater 18, the printheads, backing members 24A-24D (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the marking units 21A-21D eject ink at a temperature typically significantly higher than the temperature of the media web 14. Consequently, the ink heats the media, and temperature control devices can maintain the media web temperature within a predetermined range. For example, the air temperature and air flow rate behind and in front of the media web 14 impacts the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 5, the fixing assembly includes a "spreader" 40, that applies a predetermined pressure, and in some implementations, heat, to the media. The function of the spreader 40 is flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. In addition to spreading the ink, the spreader 40 improves fixation of the ink image to the media web 14 by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly spreads the ink using non-contact heating (without pressure) of the media after the print zone 20. Such a non-contact fixing assembly can use any suitable type of heater to heat the media to a desired temperature, such as a radiant heater, UV heating lamps, and the like.

In one practical embodiment, the roller temperature in spreader 40 is maintained at an optimum temperature that depends on the properties of the ink, such as 55° C. Generally, a lower roller temperature gives less line spread while a higher temperature produces imperfections in the gloss of the ink image. Roller temperatures that are too high may cause ink to offset to the roll. In one practical embodiment, the nip pressure is set in a range of about 500 to about 2000 psi lbs/side. Lower nip pressure produces less line spread while higher pressure may reduce pressure roller life.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14, with the printer 5 transferring approximately 1-10 mg per A4 sheet-sized portion of the media web 14. In one embodiment, the mid-heater 30 and spreader 40 are combined into a single unit, with their respective functions occurring relative to the same portion of media simultaneously. In another embodiment the media is maintained at a high temperature as the media exits the print zone 20 to enable spreading of the ink.

In printer 5, the controller 50 is operatively connected to various subsystems and components to regulate and control operation of the printer 5. The controller 50 is implemented with general or specialized programmable processors that execute programmed instructions. The instructions and data required to perform the programmed functions are stored in a memory 52 that is associated with the controller 50. The memory 52 stores programmed instructions for the controller. Additionally, the memory 52 stores image data that is generated by an optical sensor 54, the cross-process direction locations of the edges of the media web 14, data corresponding to variation in the edges of the media web 14, and data identifying inkjets in the print zone that are activated and deactivated during full-bleed printing operation. The processors, their memories, and interface circuitry configure the controllers and/or print engine to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the printheads in the marking units 21A-21D. The controller 50 generates electrical firing signals to operate the individual inkjets in the marking units 21A-21D to eject ink drops that form printed images on the media web 14. As described in more detail below, the controller 50 activates and deactivates inkjets in the marking units 21A-21D to enable full-bleed printing on the media web 14. The activated inkjets receive firing signals and eject ink drops at various times during the printing process. The deactivated inkjets do not receive the firing signals, and consequently do not eject ink drops during the printing process.

The printer 5 includes an optical sensor 54 that is configured to generate image data corresponding to the media web 14 and a backer roller 56. The optical sensor is configured to detect, for example, the presence, reflectance values, and/or location of ink drops jetted onto the receiving member by the inkjets of the printhead assembly. The optical sensor 54 includes an array of optical detectors mounted to a bar or other longitudinal structure that extends across the width of an imaging area on the image receiving member. In one embodiment in which the imaging area is approximately twenty inches wide in the cross-process direction and the printheads print at a resolution of 600 dpi in the cross-process direction, over 12,000 optical detectors are arrayed in a single row along the bar to generate a single scanline of image data corresponding to a line across the image receiving member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the media web 14, markings formed on the media web 14, and portions of a backer roll 56 support member that are exposed to the optical sensor 54. The magnitudes of the electrical signals generated by the optical detectors are converted to digital values by an appropriate analog/digital converter.

FIG. 1 depicts a process 100 for inkjet printing in a full-bleed or near full-bleed print mode. In the discussion below, a reference to the process performing a function or action refers to a controller executing programmed instructions stored in a memory to operate one or more components in a printer to perform the function or action. Process 100 is described in conjunction with the printer 5 for illustrative purposes.

During process 100, the printer 5 identifies the edges of the print medium 14 in the cross-process direction for full-bleed printing. In the printer 5, the optical sensor 54 generates image data corresponding to the print medium 14 and the backer roller 56. The reflectance of light from the backer roller is often similar to the reflectance of light from the print medium. For example, the print medium and the backer roller are both substantially white but with slightly different reflectances in many embodiments. The image data near the edges of the print medium 14, however, can indicate a transition between the print medium 14 and the backer roller 56 on either edge of the print medium 14. In one embodiment of process 100, the controller 50 calibrates the optical sensor 54 to produce image data with a decreased dynamic range between the print medium 14 and the backer roller 56 to enable accurate identification of the edge transitions in the image data (block 104). In the printer 5, the controller 50 first deactivates the light sources that are associated with the optical sensor 54 to generate a first set of "dark" image data. The controller 50 next activates the light sources and generates image data of the blank media web 14 and the backer roller 56. The controller 50 calibrates each sensing element in the sensor 54 so that the calibrated output generated by the white print medium is well below a maximum calibrated response that the calibration procedure can output.

In an exemplary configuration of the printer 5, the calibrated output of each pixel in the image data is assigned an eight-bit digital value of 0 to 255. The white level of the blank print medium would normally have a high reflectance value that is at or near 255 in order to achieve a large dynamic range. In process 100, the controller 50 instead assigns the reflectance value of the paper to a lower value, such as 180, instead of a value near 255. The lower value of the white level of the print medium 14 enables the optical sensor 54 to generate image data that more clearly delineate the transition between the print medium 14 and the backer roller 56.

Figure 4:
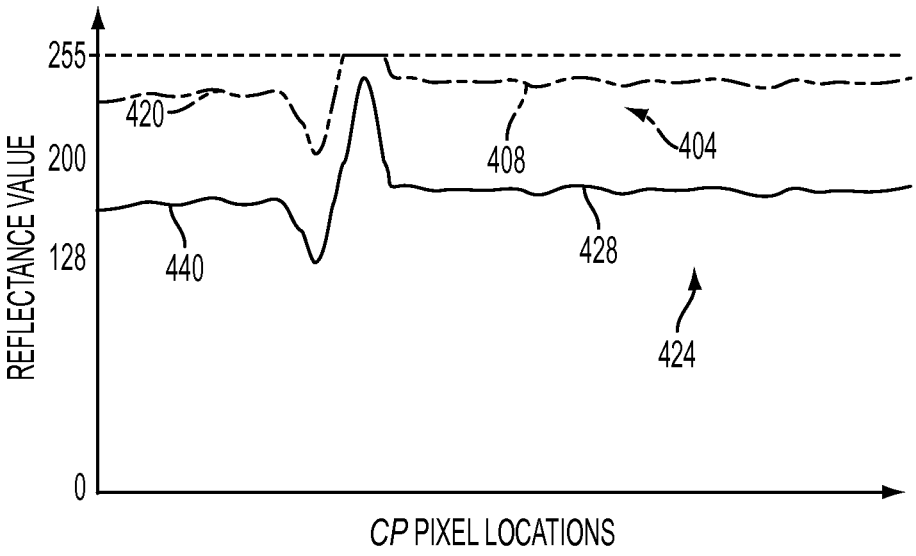
FIG. 4 is a graph depicting a transition in image data that corresponds to an edge of the print medium against a backer roller.

As depicted in FIG. 4, the optical sensor 54 generates a first set of image data 404 with a calibration point for the white print medium of approximately 240 reflectance level, which is close to the maximum white reflectance level of 255. The image data 404 include reflectance values 408 from the print medium 14, reflectance values 420 from the backer roller 56. At a later time, the paper may move relative to when the calibration was initially performed. Therefore, the pixel offsets and gains calculated for the sensor pixels appropriate for reflection off a backer roll might now be applied for reflection from the paper. If the reflectance of the backer roll is less than the paper, then the calibrated response might be clipped 255 and no information about texture and thus the paper edge transition can be obtained. The image data 424 in FIG. 4, however, are generated once the optical sensor 54 is calibrated using the processing that is described with reference to block 104. The image data 424 include reflectance values 428 from the print medium 14, reflectance values 440 from the backer roller 56. At a later time, the paper may move relative to when the calibration was initially performed. Therefore, the pixel offsets and gains calculated for the sensor pixels appropriate for reflection off a backer roll might now be applied for reflection off the paper. If the reflectance of the backer roll is less than the paper, and the white calibration level is chosen to be small enough, then the calibrated response will not be clipped at 255 and information about texture and thus the paper edge transition can be obtained.

The calibration of the optical sensor 54 as described above with reference to the processing of block 104 is an example of a method for calibrating the sensor 54 to improve edge detection of a print medium. Once the sensor is calibrated, the controller 50 processes the image data with bandpass filters and feature identification algorithms to identify the edges of the print medium 14 with reference to differences between the texture of the print medium 14, which is typically a fibrous paper, and the backer roller 56, which is typically a smooth surface. In an alternative embodiment, the backer roller is formed from a material that produces reflectance values that are sufficiently distinct from the print medium to enable the controller 50 to identify the edge of the print medium 14 with reference to the average uncalibrated reflectance values of the print medium 14 and backer roller 56.

Referring again to FIG. 1, process 100 continues with the generation of image data of the blank print medium 14 and backer roller 56 with the calibrated optical sensor 54 (block 108). In the printer 5, the optical sensor 54 generates one or more rows of pixels that extend in the cross-process direction across the print medium 14 and the backer roller 56.

Figure 2:
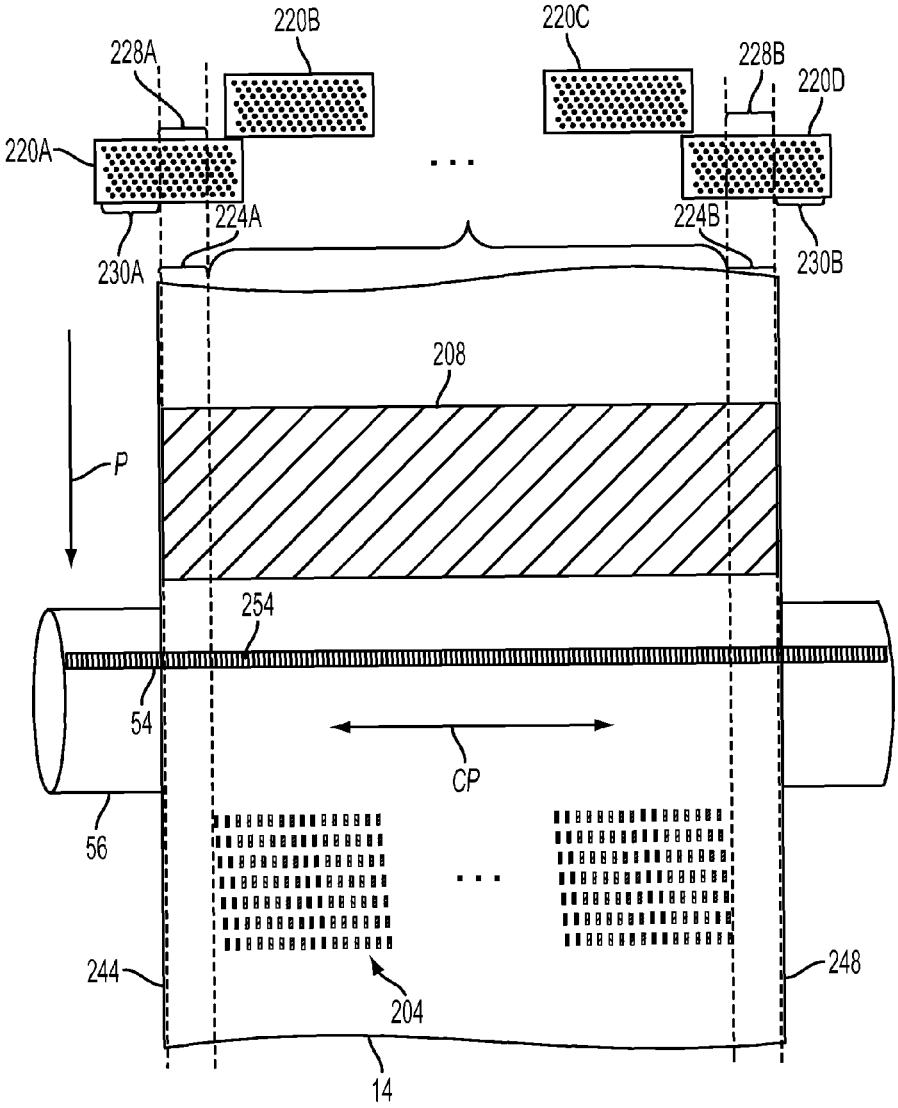
FIG. 2 is a schematic diagram depicting a portion of a print zone and an optical sensor in an inkjet printer that is configured to operate in the full-bleed or near full-bleed print mode.

FIG. 2 depicts the print medium 14, optical sensor 54, and backer roller 56 of the printer 5. In FIG. 2, the optical sensor 54 is arranged in the cross-process direction CP in parallel with the backer roller 56. The optical sensor 54 extends past the cross-process direction edges 244 and 248 of the print medium 14. The optical sensor 54 generates a row of pixel image data with each pixel being generated by one of the plurality of photodetectors, such as photodetector 254. The image data include pixels corresponding to the print medium 14, the backer roller 56, and the transition between the print medium 14 and the backer roller 56 at the edges 244 and 248.

Referring again to FIG. 1, process 100 identifies the edges of the print medium in the cross-process direction using the generated image data (block 112). The image data is converted to a texture profile using the techniques described in the previous patent application. Typically, the texture profile is low for the backer roll and high for the paper, with a transition at the edge of the paper. When the texture profile is convolved with an edge detecting kernel, the resulting profile includes two maximum amplitudes that are located at both of the transitions between the media web 14 and the backer roller 56 in the cross-process direction.

Figure 3:
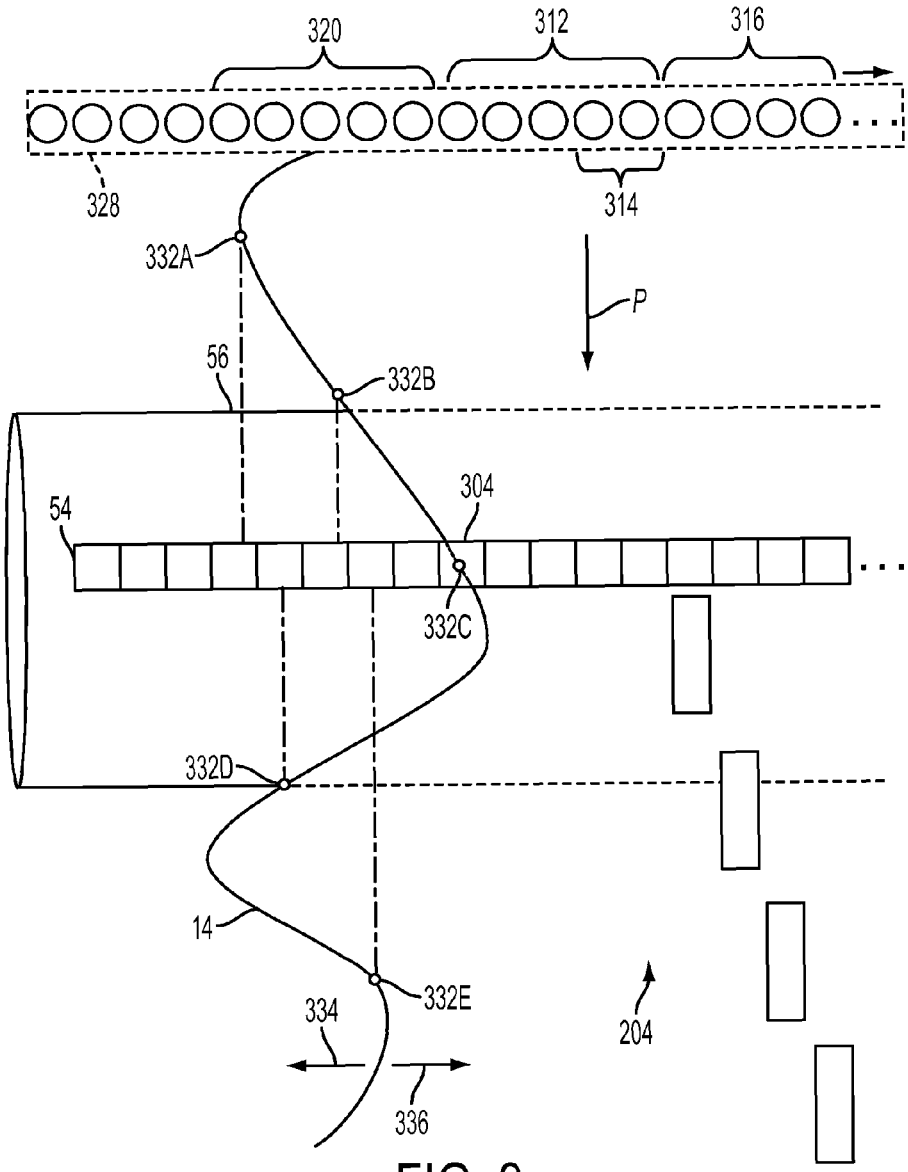
FIG. 3 is a detail view of an edge of the print medium, the optical sensor, and inkjets in the inkjet printer depicted in FIG. 2.

During process 100, the media 14 continues to move past the printheads in the marking units 21A-21D and the optical sensor 54. In many instances, the media web 14 includes ragged edges and the edges exhibit noticeable variation in the cross-process direction. Process 100 can optionally identify the variation in the cross-process direction edges of the print medium at a plurality of different times as the media web 14 moves through the media path in the process direction P (block 116). FIG. 3 depicts the optical sensor 54, backer roller 56, and media web 14 in more detail. In FIG. 3, the location of the edge of the media web varies in the cross-process direction as the media web 14 moves past the optical sensor 54 in the process direction P. The optical sensor 54 generates image data at a plurality of locations 332A, 332B, 332C, 332D, and 332E, for example, to identify samples of different cross-process direction locations of the media web. In FIG. 3, an optical detector 304 in the optical sensor 54 is aligned with the edge of the media web 14. The transition between the media web 14 and the backer roller 56 typically generates an image data profile that includes pixels from multiple photodetectors in the optical sensor 54 that are proximate to the edge of the media web 14. The controller 50 identifies an average variation that corresponds to the raggedness of the edges of the media web 14. The processing described with reference to block 112 can be repeated during a print job to enable the printer 5 to continuously monitor changes in the edge variation of the media web 14.

In another embodiment, the variation of the edges in the print medium are determined prior to the commencement of the process 100 and the value of the predetermined variation is stored in the memory 52. Some print media, such as individually cut sheets, exhibit little or no edge variation. Printer configurations that operate in a full-bleed print mode using print media that are substantially free of edge variation can omit the processing described above with reference to block 112.

Process 100 continues with the formation of a printed test pattern on the print medium with blank margins between the test pattern and the edges of the print medium in the cross-process direction (block 120). In FIG. 2, a printed test pattern 204 is formed on the media web 14. The exemplary test pattern 204 can be used for a wide range of operations in the printer 5 including, but not limited to, printhead registration and inoperable inkjet detection. The exemplary test pattern 204 includes a plurality of dashes formed from inkjets in the printheads of the marking units 21A-21D. The test pattern 204 can, however, include different arrangements of markings, including a simplified test pattern that only includes marks formed by inkjets in printheads that are proximate to the cross-process direction edges of the media web 14, such as printheads 220A and 220D in FIG. 2.

FIG. 2 includes a simplified view of selected printheads 220A, 220B, 220C, and 220D that generate at least a portion of the dashes in the test pattern 204. In FIG. 2, the printheads 220A and 220D are located at either end of the printhead array in the cross-process direction CP, and at least some of the inkjets in the printheads 220A and 220D are located beyond the edges 244 and 248, respectively, of the media web 14. The printer 5 forms the test pattern 204 with margins 224A and 224B extending from the edges 244 and 248, respectively, of the media web 14. Some of the inkjets in the printheads 220A and 220D that correspond to the margins 224A and 224B and areas beyond the edges 244 and 248 of the media web 14 remain deactivated during the printing of the test pattern 204. The controller 50 stores identifiers corresponding to both the activated and deactivated inkjets in the memory 52.

In the example of FIG. 2, the margins 224A and 224B are large enough to ensure that the markings in the test pattern 204 are formed only on the media web 14 and do not extend past either edge of the media web 14 in the cross-process direction, even when a precise relationship between the locations of the inkjets and the edges of the media web 14 has not been identified. Examples of suitable margin sizes in the printer 5 include margins of between two and five centimeters in the cross-process direction CP. The sizes of the margins are approximate because the printer 5 has not identified a precise size of each margin prior to forming the test pattern 204 on the media web 14.

After forming the test pattern, process 100 generates additional image data corresponding to the printed test pattern on the media web, and identifies the cross-process direction distances between the edges of the print medium and either end of the test pattern (block 124). Again referring to FIG. 2, the optical sensor 54 generates image data corresponding to the test pattern 204, including the cross-process direction locations of marks in the test pattern 204 that are proximate to the margins 224A and 224B. The controller 50 identifies the cross-process direction distance between the marks in the test pattern 204 and the edges 244A and 244B with reference to the identified edge locations and the image data of the test pattern 204.

After identifying the distance between the test pattern and the edges of the media web, process 100 activates additional inkjets in the print zone to enable the printer to print in a full-bleed mode (block 128). In the printer 5, the controller 50 activates at least a portion of the inkjets in the printheads that remained deactivated during the printing of the test pattern 204. For example, in FIG. 2, the printhead 220A does not operate inkjets 228A, corresponding to the margin 224A, and inkjets 230A that are beyond the edge 244 of the media web 14, while forming the test pattern 204. The printhead 220B does not operate inkjets 228B, corresponding to the margin 224B, and inkjets 230B that are beyond the edge 248 of the media web 14. The controller 50 activates at least some of the deactivated inkjets to print a full-bleed ink image 208 on the media web 14.

In the processing described with reference to block 128, the controller 50 selectively activates different groups of inkjets with reference to the identified edges of the media web 14, variation in the media web 14, and one or more predetermined operating parameters. FIG. 3 depicts an exemplary group of inkjets 328 in a printhead that is located at an edge of the media web 14 in more detail. The inkjets 316 are activated and form a portion of the test pattern 204. The inkjets 312 correspond to the margin on the media web 14 between the inkjets 316 and the edge of the media web 14 at location 332C. The inkjets 320 correspond to the ragged or varying regions at the edge of the media web 14.

In one configuration, the controller 50 activates each of the inkjets 312 including the margin and to an average location of the edge of the media web 14 that is identified with reference to the variation in the location of the edge in the cross-process direction. The activated inkjets 312 eject ink drops for full-bleed printing. Due to variation in the media web 14, the edge of the media web 14 can extend past the inkjets 312 in direction 334, which leaves a small margin that is typically imperceptible or minimally perceptible. Additionally, the edge of the media web 14 can move inward in direction 336 so that one or more of the inkjets 312 eject ink drops onto one of the backing members 24A-24D instead of the media web 14. The amount of ink that is formed on the backing members 24A-24D is typically small and has a minimal impact on the operation of the printer 5. In configurations where the print medium exhibits little or no edge variation, the printer 5 can activate each of the inkjets 312 to enable full-bleed printing where substantially all of the ejected ink drops land on the print medium and the full-bleed printed image has no margin in the cross-process direction.

In another configuration, the printer 5 operates in a near full-bleed print mode where less than all of the inkjets corresponding to the margin are activated. For example, the controller 50 activates only inkjets 314. The activated inkjets leave a small margin at the edge of the media web 14, which is typically on the order of 50 to 200 microns in size. The near full-bleed print mode ensures that the ink drops land on the media web 14 and not on the backing members 24A-24D, even when the location of the edge of the media web 14 varies in the cross-process direction.

In still another configuration, the printer 5 operates additional inkjets that go beyond the identified edge of the media web 14. For example, in FIG. 3, the controller 50 activates some or all of the inkjets 320. The activation of the additional inkjets ensures full-bleed printing on the media web 14 even when the location of the edge of the media web 14 varies in the cross-process direction. Ink drops from some of the inkjets 320 can land on one of the backing members 24A-24D when the edge of the media web 14 is offset in direction 336 from the inkjets 320.

Referring again to FIG. 1, the printer continues printing in the full-bleed print mode. During the printing operation, the media web 14 may drift or oscillate in the cross-process direction. While variation in the edge of the media web 14 may be random, the drift systematically shifts the edges of the media web in the cross-process direction. The drift may result in one side of the media web having a perceptible margin while inkjets on the other side of the media web eject ink drops onto the backing members 24A-24D instead of the media web 14. To reduce or eliminate the effects of media web drift, process 100 periodically identifies the cross-process direction location of the edges of the media web 14 during the printing operation (block 132). The printer 5 identifies the edges of the print medium using data processing that is substantially the same as the processing described above with reference to blocks 104-112. During the printing operation, blank sections of the print medium in inter-document zones periodically pass the optical scanner 54 to enable the controller 50 to identify changes in the location of the media web in the cross-process direction.

If the media web 14 remains within the predetermined distance from the previously identified location (block 136), then the printer 5 continues printing in the full-bleed or near full-bleed print mode (block 140). If the identified locations of the edges change by more than a predetermined threshold (block 136), then the controller 50 activates and deactivates additional inkjets in the printheads to compensate for the change in the location of the media web 14 (block 144). In one configuration, the threshold distance corresponds to approximately fifty microns in the cross-process direction. The printer 5 identifies the cross-process location of the media web 14 during the full-bleed print mode and adjusts the activated inkjets in an iterative manner during process 100 as described above with reference to the processing of blocks 132-144.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of operating an inkjet printer comprising:

calibrating an optical sensor to a first white level for a blank portion of a surface of a print medium that moves over a support member, the first white level being less than a maximum white level for the optical sensor to enable the optical sensor generate image data of a transition from a first texture of the print medium to a second texture of the support member with a maximum white level generated in image data corresponding to the transition being less than the maximum white level of the sensor;

generating with the optical sensor after the calibration first image data of the blank portion of the surface of the print medium and the support member;

identifying a location of an edge of the print medium in the first image data with reference to the transition between a first portion of the first image data corresponding to the first texture of the print medium and a second portion of the first image data corresponding to the second texture of the support member;

ejecting ink drops from a first plurality of inkjets to form a plurality of marks on the surface of the print medium in a region having a first predetermined size;

generating, with the optical sensor, second image data corresponding to the surface of the print medium and the plurality of marks on the surface of the print medium;

identifying with reference to the second image data a region on the surface of the print medium that is between the plurality of marks on the surface of the print medium in the region having the first predetermined size and the location of the edge of the print medium in a cross-process direction;

identifying a second plurality of inkjets that are positioned to eject ink drops outside of the region having the first predetermined size and onto the print medium; and activating the second plurality of inkjets to enable the first plurality of inkjets and the second plurality of inkjets to eject ink drops during a printing operation.

2. The method of claim 1, the activation of the second plurality of inkjets further comprising:

activating only a portion of the second plurality of inkjets that are at least a predetermined distance from the location of the edge of the print medium in the cross-process direction.

3. The method of claim 2, the predetermined distance being between 10 microns and 100 microns in the cross-process direction.

4. The method of claim 2, further comprising:

identifying an average variation in the location of the edge as the predetermined distance.

5. The method of claim 1, the activation of the second plurality of inkjets further comprising:

activating at least one additional inkjet positioned to eject ink drops at a location that is beyond the location of the edge of the print medium in the cross-process direction during the printing operation.

6. The method of claim 1, further comprising:

identifying with reference to the first image data a plurality of cross-process direction locations of the edge of the print medium in the cross-process direction as the print medium moves past the optical sensor in a process direction with reference to a plurality of cross-process direction locations of transitions between portions of the first image data corresponding to the support member and other portions of the first image data corresponding to the print medium, the transitions being identified with reference to transitions between the first portion of the first image data corresponding to the first texture of the print medium and the second portion of the first image data corresponding to the second texture of the support member; and identifying a variation of the location of the edge of the print medium in the cross-process direction with reference to the plurality of identified cross-process direction locations of the edge of the print medium.

7. The method of claim 6, the activation of the second plurality of inkjets further comprising:

activating only a portion of the second plurality of inkjets that are at a distance from the edge of the print medium in the cross-process direction that is greater than or equal to the identified variation of the location of the edge of the print medium in the cross-process direction.

8. A printer comprising:

a media transport configured to move a print medium through the printer in a process direction;

a plurality of inkjets configured to eject ink drops onto the print medium, the plurality of inkjets being arranged in a cross-process direction;

an optical sensor configured to generate image data corresponding to a surface of the print medium, and ink marks formed on the print medium and a support member over which the media transport moves the print medium in the process direction; and a controller operatively connected to the media transport, the plurality of inkjets, and the optical sensor, the controller being configured to:

calibrate the optical sensor to a first white level for a blank portion of the surface of the print medium, the first white level being less than a maximum white level for the optical sensor to enable the optical sensor generate image data of a transition from a first texture of the print medium to a second texture of the support member with a maximum white level generated in image data corresponding to the transition being less than the maximum white level of the sensor;

generate first image data of the blank portion of the surface of the print medium and the support member with the optical sensor after the calibration;

identify a location of an edge of the print medium in the first image data with reference to the transition between a first portion of the first image data corresponding to the first texture of the print medium and a second portion of the first image data corresponding to the second texture of the support member;

generate firing signals for a first portion of the plurality of inkjets to eject ink drops to form a plurality of marks on the surface of the print medium in a region having a predetermined size;

generate second image data corresponding to the surface of the print medium and the plurality of marks on the surface of the print medium in the region having the predetermined size;

identify with reference to the second image data a region on the print medium between the plurality of marks on the surface of the print medium in the region having a predetermined size and the location of the edge of the print medium in a cross-process direction;

identify a second portion of the plurality of inkjets that are positioned to eject ink drops outside of the region having the predetermined size and on the print medium; and generate firing signals for the second portion of the plurality of inkjets to eject ink drops outside of the region having the predetermined size and onto the print medium during a printing operation.

9. The printer of claim 8, the controller being further configured to:

generate firing signals only for inkjets in the second portion of the plurality of inkjets that are at least a predetermined distance from the location of the edge of the print medium in the cross-process direction.

10. The printer of claim 9, the predetermined distance being between 10 microns and 100 microns in the cross-process direction.

11. The printer of claim 9, the controller being further configured to:

identify an average variation in the location of the edge as the predetermined distance.

12. The printer of claim 8, the controller being further configured to:

generate firing signals for at least one additional inkjet positioned to eject ink drops at a location in the cross-process direction that is beyond the location of the edge of the print medium during the printing operation.

13. The printer of claim 8, the controller being further configured to:

identify with reference to the first image data a plurality of cross-process direction locations of the edge of the print medium in the cross-process direction as the print medium moves past the optical sensor in the process direction with reference to a plurality of cross-process direction locations of transitions between portions of the first image data corresponding to the support member and other portions of the first image data corresponding to the print medium as the media transport moves the print medium in the process direction the transitions being identified with reference to transitions between the first portion of the first image data corresponding to the first texture of the print medium and the second portion of the first image data corresponding to the second texture of the support member; and identify a variation of the location of the edge of the print medium in the cross-process direction with reference to the plurality of identified cross-process direction locations of the edge of the print medium.

14. The printer of claim 13, the controller being further configured to:

activate only a portion of the second plurality of inkjets that are at a distance from the location of the edge of the print medium in the cross-process direction that is greater than or equal to the identified variation of the location of the edge of the print medium in the cross-process direction.

* * * * *